US007186185B2

(12) United States Patent
Nagy

(10) Patent No.: US 7,186,185 B2
(45) Date of Patent: Mar. 6, 2007

(54) GOLD CLUB WITH CUSTOMIZABLE ALIGNMENT SIGHTING AND WEIGHTING DEVICE

(76) Inventor: Lajos I. Nagy, 1804 Ala Moana Blvd. #5A, Honolulu, HI (US) 96815

( * ) Notice: Subject to any disclaimer, the term of this patent is extended or adjusted under 35 U.S.C. 154(b) by 249 days.

(21) Appl. No.: 10/949,076

(22) Filed: Sep. 24, 2004

(65) Prior Publication Data

US 2006/0068928 A1 Mar. 30, 2006

(51) Int. Cl.
*A63B 69/36* (2006.01)
*A63B 53/08* (2006.01)

(52) U.S. Cl. ..... 473/238; 473/241; 473/242; 473/249; 473/251; 473/254; 473/334; 473/339

(58) Field of Classification Search ..... 473/238–254, 473/334–339, 219–226
See application file for complete search history.

(56) References Cited

U.S. PATENT DOCUMENTS 3,199,873 A * 8/1965 Surratt ..... 473/251
3,548,504 A * 12/1970 Sykes ..... 33/286
3,880,430 A 4/1975 McCabe
3,909,004 A * 9/1975 Vella ..... 473/241
4,136,877 A 1/1979 Antonius
4,291,883 A * 9/1981 Smart et al. ..... 473/244
4,340,229 A * 7/1982 Stuff, Jr. ..... 473/240
4,343,472 A 8/1982 Hamilton
4,722,528 A 2/1988 Tsao
4,824,114 A * 4/1989 Catalano ..... 473/251
4,902,014 A * 2/1990 Bontomase et al. ..... 473/241
5,388,832 A * 2/1995 Hsu ..... 473/220
5,409,228 A * 4/1995 Botsch ..... 473/249
5,429,366 A * 7/1995 McCabe ..... 473/244
5,433,446 A * 7/1995 Lindstedt, Jr. ..... 473/242

(Continued)

*Primary Examiner*—Sebastiano Passaniti
(74) *Attorney, Agent, or Firm*—Leighton K. Chong; Godbey Griffiths Reiss & Chong

(57) ABSTRACT

A customizable alignment sighting device for a golf club is mounted to an upper surface of the head of the golf club with a sighting element providing the user a visual target indicator for desired alignment of the club head with the user's line of sight. The sighting element can be readily adjusted for the user's preferences. When not aligned, the sighting element provides an indication of the magnitude and direction of misalignment. In one embodiment, the device is shaped as a planar disc mounted on the upper surface of the club head by leveling posts spaced around its periphery. The sighting element is a concave lens or lenticulated grid or grill superimposed on a target image. In another embodiment, the device has a 3D device body mounted in a mounting cup or socket fastened to or formed in the head of the golf club. The device body has a larger-diameter circle marked around an annular opening, and a smaller-diameter circle marked depthwise inside the opening in the device body to provide a target of concentric circles by parallax effect. The device body can be formed as a sphere with axially split sides that are expanded outward when an expansion plug is threaded in the bottom, providing an interference fit holding it in position in the mounting cup. The spherical body can be formed with 4 alignment sighting holes at 90° intervals around a vertical plane and provided with a weighting element fixed at an offset position, such that it can be rotated to use any of the different alignment holes for adjusting the weight distribution in the club head.

15 Claims, 9 Drawing Sheets

U.S. PATENT DOCUMENTS 5,462,279 A 10/1995 Culpepper
5,692,964 A * 12/1997 Smith et al. ..... 473/220
5,839,969 A * 11/1998 Klouda ..... 473/220
5,921,868 A 7/1999 DiMartino
6,227,983 B1 * 5/2001 Yang ..... 473/220
6,261,190 B1 7/2001 Ashcraft
6,394,910 B1 5/2002 McCarthy

* cited by examiner

FIGURE 2A
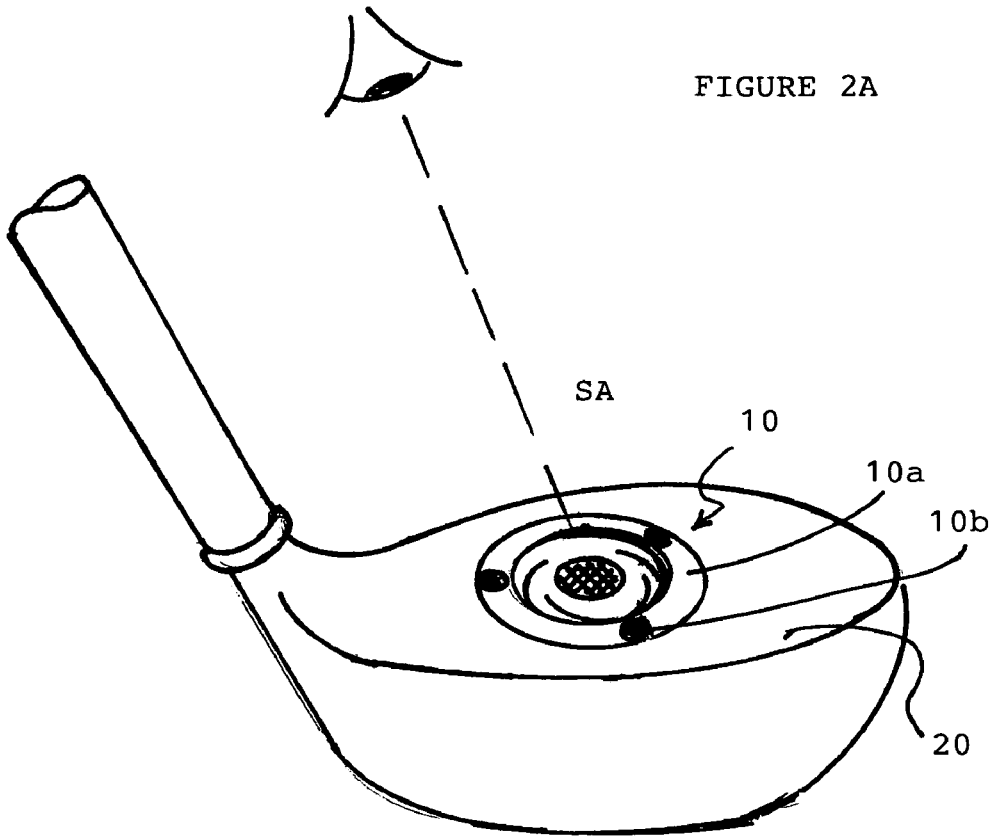
FIGURE 2B
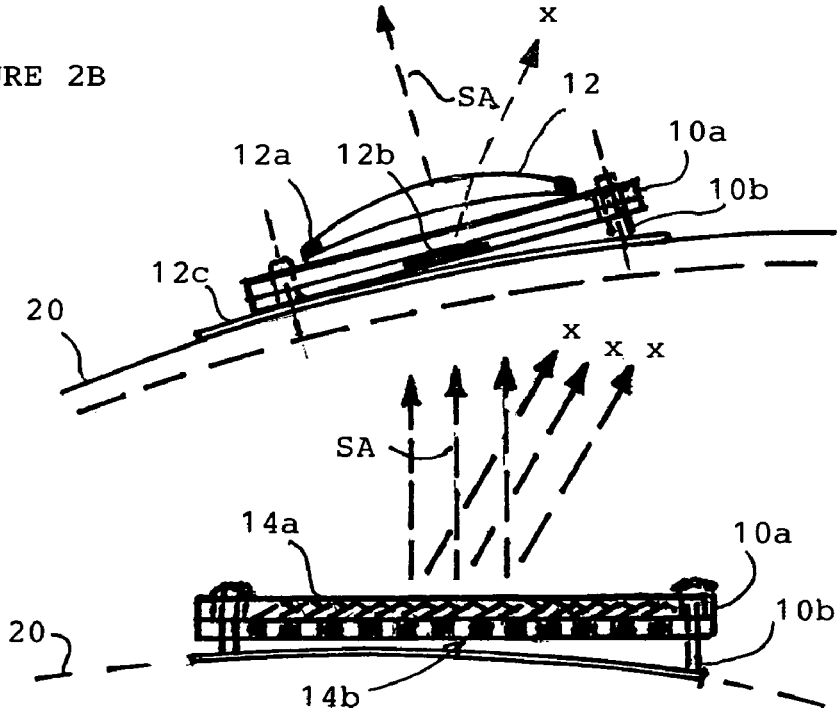
FIGURE 2C

FIGURE 4A
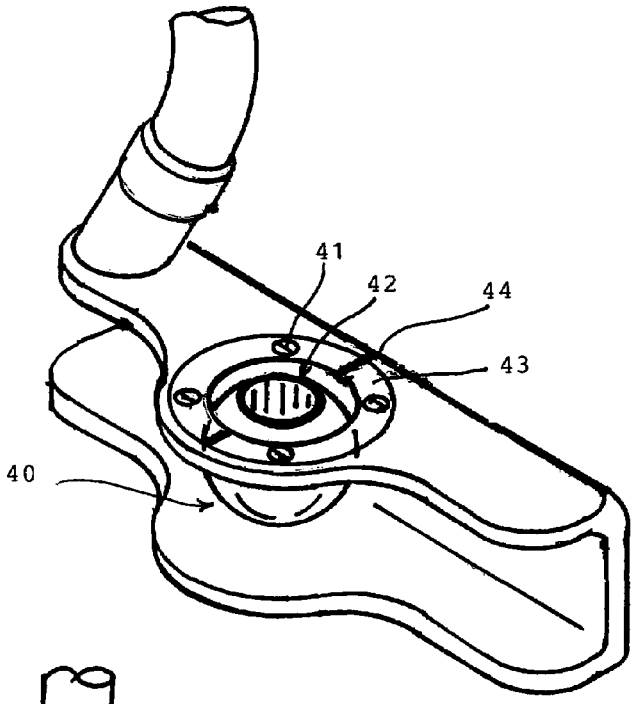
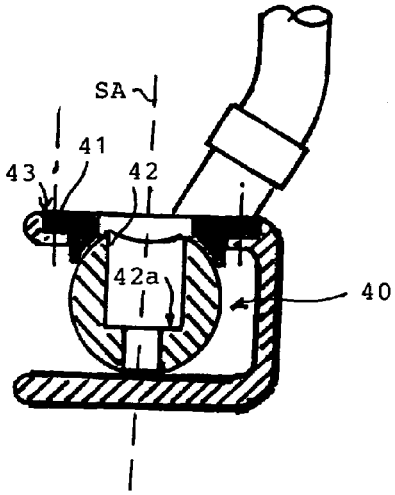
FIGURE 4B
FIGURE 4C
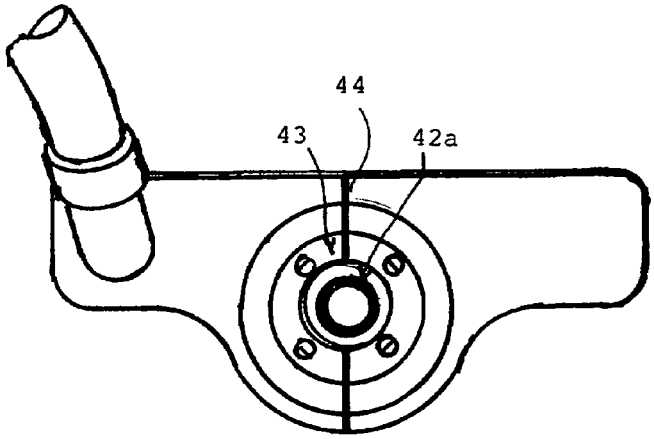

FIGURE 8B
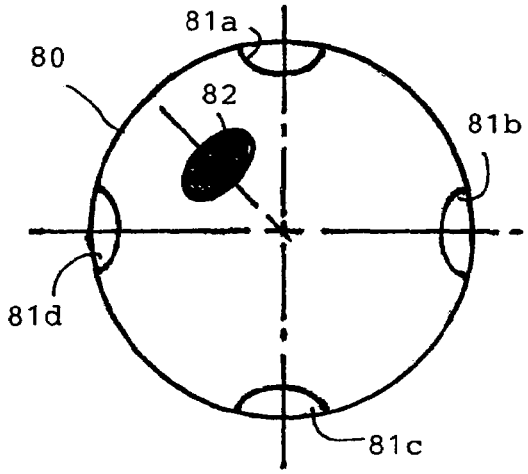
FIGURE 8C
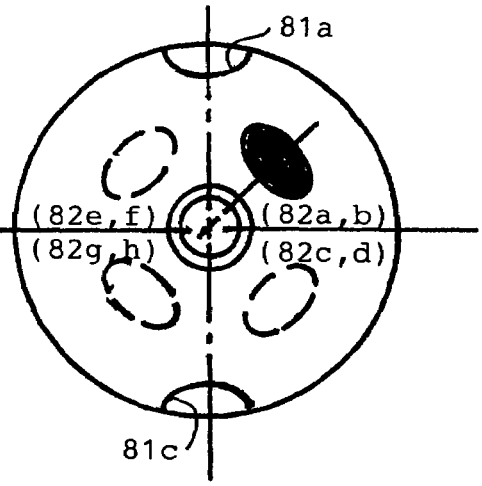
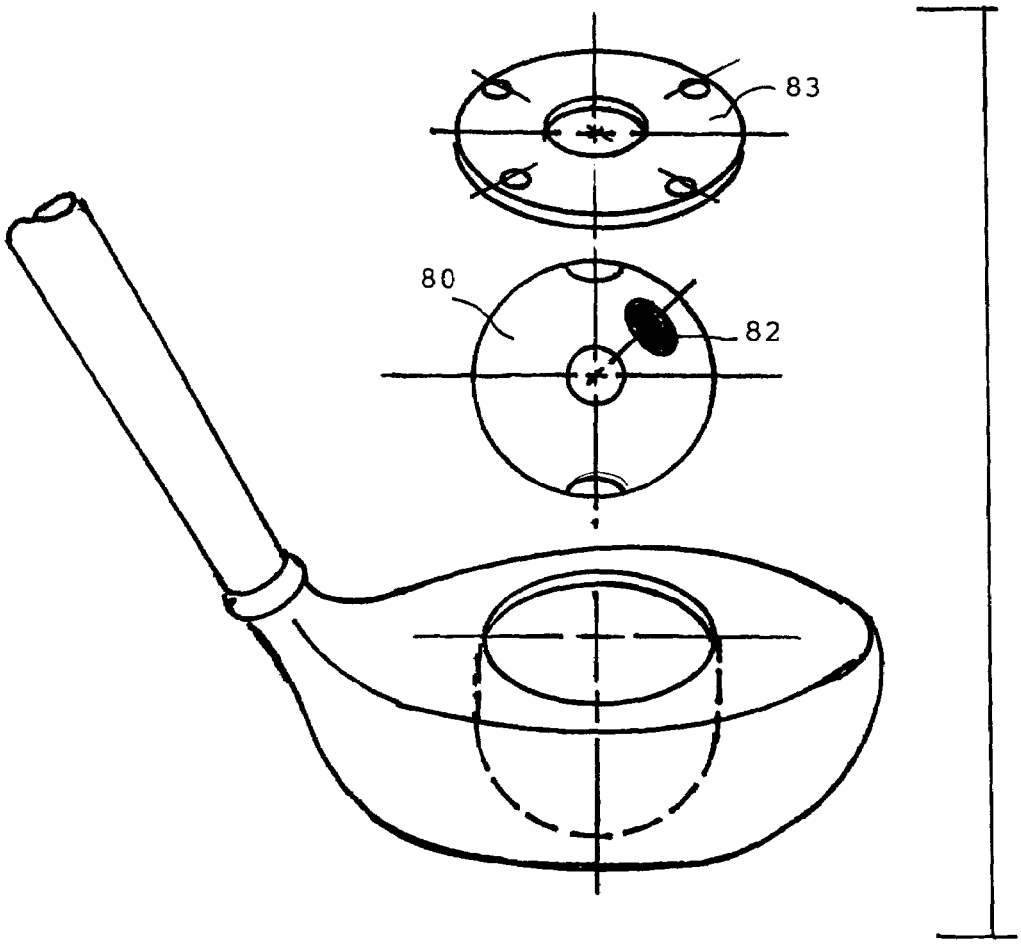
FIGURE 8D

80

81a
81b
81d
81c
91

82

81a
81b
81d
81c

82

GOLD CLUB WITH CUSTOMIZABLE ALIGNMENT SIGHTING AND WEIGHTING DEVICE

TECHNICAL FIELD

This invention generally relates to a golf club alignment sighting and weighting device, and more particularly, to one that provides an accurate sighting function for the user by attachment on the golf club itself with a minimum of intrusion or interference.

BACKGROUND OF INVENTION

Golf is an excruciating game in which small misalignments of the golfer's posture, hand position, and club position at address of the ball relative to the target can be greatly magnified into an unwanted result. All players strive for ever more consistency in alignment at address and execution of a swing which will deliver an accurate stroke. Referring to FIG. 1, the general objective of proper alignment is to position the head (eyes) of the golfer along a vertical line VV bisecting the golfer's stance, the feet along a horizontal line HH aimed toward the target, and the golfer's center of gravity over the feet so as not to lean too far forward or back in the stance. The club head during the swing should sweep on the horizontal line with the sole of the club head parallel to the ground.

However, the specific alignment optimum for an individual golfer depends on many swing factors and individual factors. For different types of shots, club lengths, weights, and/or pitches, the ball (and therefore the club head at address) may be positioned forward, at center, or slightly back of the stance. The golfer's hands (and club shaft and grip) may be positioned on the line of sight to the club head, slightly forward of it, or quite a bit forward depending on the type of swing desired to be executed. The golfer's height, build, posture, body mechanics, and personal preferences must also be factored in. Therefore, the optimum alignment for an individual golfer with each particular club is subject to wide variability, even though the general objective is the same.

Throughout the years, many types of alignment sighting devices have been proposed to help a golfer see when the head, face and/or shaft of a club is aligned in the proper position relative to the golfer's line of sight to the club head. For example, U.S. Pat. No. 3,880,430 to McCabe, U.S. Pat. No. 4,136,877 to Antonius, U.S. Pat. No. 4,343,472 to Hamilton, U.S. Pat. No. 4,722,528 to Tsao, U.S. Pat. U.S. Pat. No. 5,921,868 to DiMartino, U.S. Pat. No. 6,261,190 to Ashcraft, and U.S. Pat. No. 6,394,910 to McCarthy show align devices for aligning the head or face position of putters. However, these generally are assembled or fabricated with the alignment sighting component in a fixed position which cannot be varied despite different individual factors or preferences of golfers. As a result, they are used only with putters (rather than irons or woods too) since there is much less variation in optimal alignment for individual factors and preferences. Other types of alignment sighting devices used for other clubs include sighting rods that attach to the club shaft and may be adjusted to individual preferences, but these have the problem that they are bulky or intrusive for the user when positioned on the shaft.

SUMMARY OF INVENTION

Accordingly, it is a principal object of the present invention to provide a golf club alignment sighting device which can be attached to different types of golf clubs and adjusted for alignments for different individual factors or preferences of golfers. It is a further object of the invention to provide a device which provides accurate alignment sighting, while also providing an indication of the direction of misalignment. Another object is for the device to be easy to adjust, and to present a minimum of intrusion or interference when attached to the golf club. It is another object that the sighting device can allow adjustment of the club head's weighting (moment of inertia).

In accordance with the present invention, an alignment sighting device for a golf club having a shaft attached to a club head comprises:

mounting means for mounting the device to an upper surface of the head of the golf club for facing toward the eyes of the user of the club;

sighting means carried on the mounting means in an adjustable sighting position for providing the user a visual target indicator of desired alignment of the club head (and shaft) with the user's line of sight to the sighting means; and adjusting means carried on the mounting means for adjusting the sighting position of the sighting means so that the user can adjust the sighting means to provide the visual indicator of desired alignment according to the user's individual alignment factors and preferences.

In a first embodiment of the invention, the device is shaped as a planar disc mounted on the upper surface of the club head by a number (3 or more) of threaded leveling posts spaced around its periphery. The device has a concave lens or lenticulated grid or grill superimposed on a target image to provide the target indicator to the user only along its sighting axis. In the lens version, the outer rim of the lens serves as an outer circle of the target indicator, and the target image seen through the lens serves an the inner circle of the target indicator. When the user's line of sight is aligned with the sighting axis, the inner and outer circles are seen as concentric, thus providing the desired target indicator. If the user's line of sight is not aligned with the sighting axis, the inner and outer circles are not concentric, and can even provide an indication (by lens refraction of the target image displaced relative to the outer circle) of the direction of misalignment. The sighting position (sighting axis) of the device can be adjusted in 3-dimensional angular adjustment by threading one or more of the leveling posts up or down to vary the angular position of the sighting axis relative to the desired head position of the user.

In a second embodiment designed for a putter, the device is shaped as a sphere mounted between upper and lower horizontal flanges of the putter head, and clamped in position with an annular collar retained by threaded screw fasteners. The spherical device has an annular opening leading into a hollow tube aligned with the sighting axis extending into the spherical body. The bottom of the tube is imprinted with a contrasting color or texture that serves as an inner circle of the target indicator. The annular collar or the annular opening serves as an outer circle of the target indicator. The desired target indicator of concentric circles is provided when the user's line of sight is aligned with the sighting axis. The device can also provide an indication of the magnitude and direction of misalignment, by parallax displacement or eclipsing of the inner circle relative to the outer circle. The sighting axis of the device can be adjusted by loosening the collar, realigning the spherical body, and re-tightening the collar.

In a third embodiment for a putter, the spherical body (as in the second embodiment) is mounted with an interference fit in a mounting cup, and the cup is mounted on a putter using a flange, threaded end, or bracket. To provide the interference fit, the spherical body has axially split sides that can be expanded outward when an expansion plug threaded into the bottom of the hollow tube is turned with a hex wrench inserted through the tube opening. Expansion of the split sides allows the spherical body to be retained tightly in a desired angular position in the mounting cup.

In a fourth embodiment for an iron club, the device is shaped as a sphere with split sides, as in the third embodiment, mounted in a mounting socket formed in an upper surface of the club head. As in the third embodiment, the spherical device is retained tightly in any desired angular position in the mounting socket by turning the expansion plug.

In a fifth embodiment for a driver or wood, the device is shaped as a sphere with split sides, as in the fourth embodiment, mounted in a mounting socket formed in an upper surface of the club head. However, the spherical device has 4 alignment sighting holes formed at 90° intervals around a vertical plane with respect to a vertical axis of the club. A weighting element is fixed in the spherical body at a predetermined offset position relative to the vertical plane of the alignment sighting tubes. The spherical body can be rotated to expose any one of the 4 alignment sighting holes through the upper annular opening of the mounting socket and fastened by expansion into position. Depending on which holes is rotated to the upper annular opening, the weighting element can be positioned in one of 4 offset positions to adjust the moment of inertia of the club head.

Other objects, features, and advantages of the present invention will be explained in the following detailed description of the invention having reference to the appended drawings.

BRIEF DESCRIPTION OF DRAWINGS

FIG. 2A illustrates a first embodiment of the alignment sighting device of the invention, FIG. 2B shows a lens version, and FIG. 2C shows a lenticulated grid or grill version.

FIG. 4A illustrates a second embodiment of the device for a putter formed as a spherical body held by a retaining collar, FIG. 4B shows a side elevation view, and FIG. 4C shows a plan view.

FIG. 8B illustrates a fifth embodiment of the 3D alignment sighting device provided with a weighting element to adjust the club's moment of inertia, FIG. 8C shows the device in side or end view, and FIG. 8D shows an assembly view of the device.

DETAILED DESCRIPTION OF INVENTION

Figure 1:
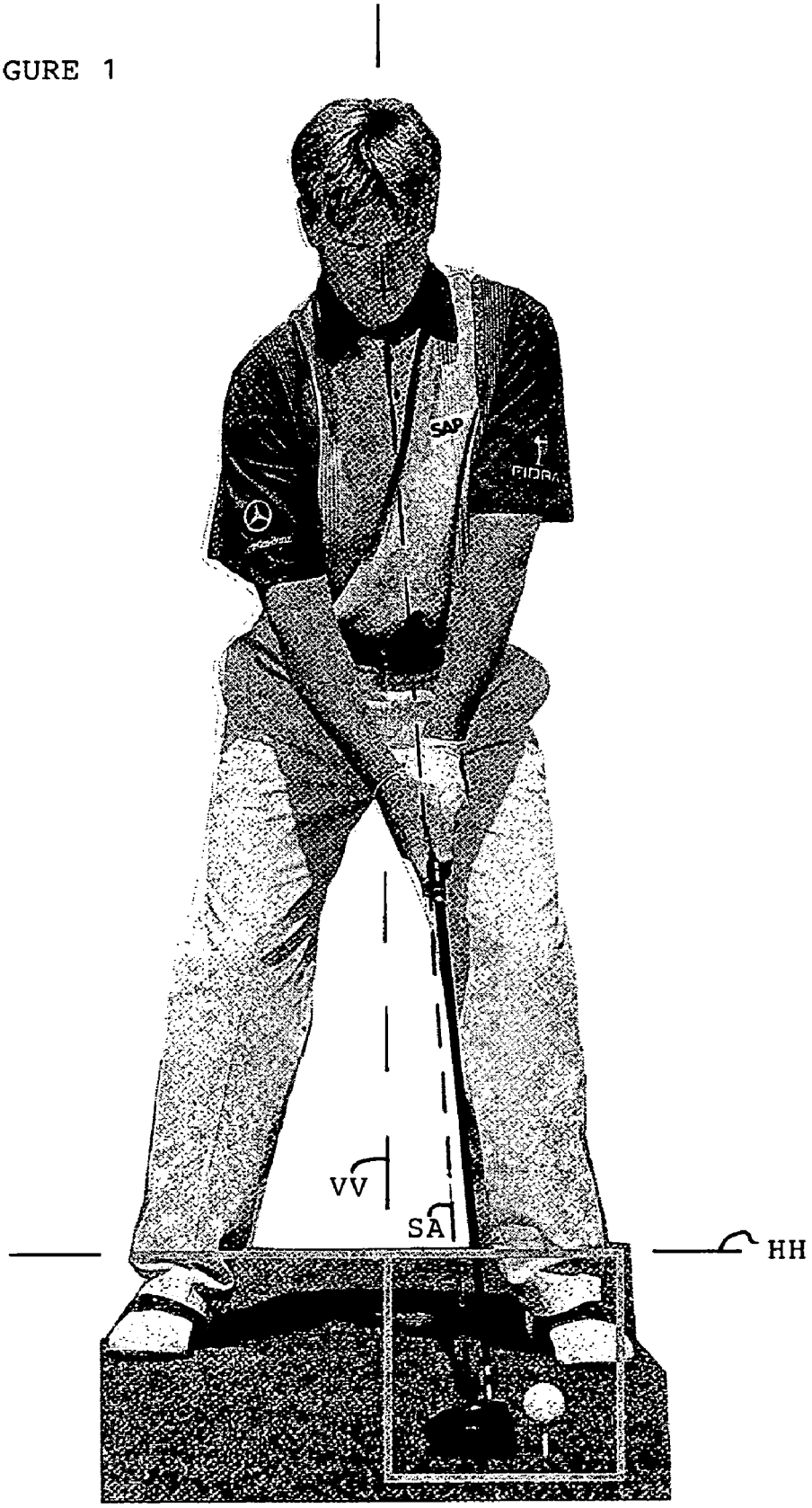
FIG. 1 illustrates use of the alignment sighting device of the present invention for consistently positioning of a golfer's head, hands, and club head in a desired alignment.

Referring again to FIG. 1, the present invention provides a golf club alignment sighting device that is attached to the upper surface of a golf club and has a sighting axis SA which indicates when the device (indicated by the head of the sighting axis arrow) on the club head is in proper alignment with the head (eyes) of the user. The device is made angularly adjustable on the mounting surface of the club head such that when the user can adjust it to a preferred alignment position. When the user is in the proper alignment relative to the sighting axis SA, the device provides an "on-target" visual indicator, whereas in other positions not in alignment, the device provides no target indicator or can provide an indication of the direction of misalignment. The device is made compact to fit on the upper surface or within the body of the club head, so as to present a minimum of intrusion or interference when attached to the golf club.

The device provides a visual sighting aid to allow a golfer to customize their clubs (driver, wood, iron, and/or putter) for training to their optimal or preferred body alignment relative to the club at set-up prior to striking the ball. The optimal or preferred alignment maybe determined by a club fitter or teaching pro, or may be selected by the golfer. Because the device is made easy to adjust (with a screw driver or hex wrench), the golfer can also make adjustments to the sighting axis at a driving or while on a golf course, to take into account variations such as type of terrain, weather, or wind. Alternatively, the device can be made adjustable only with a special tool that is not carried by the golfer, in order to comply with USGA rules for conforming golf equipment.

When the device is installed and adjusted to the preferred sighting position on a given club, the golfer can set up at address to the ball and immediately see whether or not the head (eyes) is in the preferred alignment position relative to the club head (determined by the position of the hands, posture and stance). The device can also provide a visual indication of the direction of misalignment, thereby allowing the golfer to make small physical adjustments to head, hands, posture, and stance until a "natural" feeling is achieved at the preferred alignment position. This visual sighting device will help golfers to train themselves into their basic natural stance when addressing the ball with more consistency, more accuracy, and increased confidence. The sighting device is responsive to all of the factors that determine the golfer's head (eyes) location relative to the club head, and thus provides a training aid not achieved by other devices that only help the golfer align the angle of the club head, the position of the ball, or the swing path.

In FIG. 2A, a first embodiment of the golf club alignment sighting device of the present invention is shaped as a planar disc 10 that is mounted on the upper surface 20 of the head of a golf club. The disc has a number (3 or more) of leveling posts 10*b* spaced around a peripheral rim or ring 10*a*. By adjusting the leveling posts 10*b*, the sighting axis SA of the device can be adjusted three dimensionally to a sighting position that is in the preferred alignment position with the eyes of the user. If the user takes up a posture, grip, or stance that results in the user's head (eyes) being out of alignment with the sighting axis SA, the device 10 will not provide the desired target indicator, but would instead provide an indication that the user is not in alignment.

In FIG. 2B, one version of the planar disc embodiment is shown having a concave lens element 12 mounted on the peripheral ring 10*a* concentric with the sighting axis SA of the device. The lens element 12 can be adhered by epoxy or other adhesive layer to the mounting ring 10*a* and has an outer circle 12*a* of a dark or contrasting color imprinted on its outer periphery. Alternatively, the contrast-colored outer circle can be imprinted on or incorporated with a retaining ring holding the lens element on the mounting ring 10*a*. The lens element 12 is superimposed over a lower layer having an inner circle or bullseye 12*b* imprinted in the center thereof, concentric with the sighting axis SA. When the inner circle 12*b* is sighted along the sighting axis SA of the device, it appears concentric with the outer circle 12*a*. Due to a high index of refraction of the lens element 12, the inner circle 12*b* will appear displaced from concentricity with the outer circle 12*a* when viewed at an angle (x) out of alignment with the sighting axis SA. The displacement from concentricity can provide the user a useful indication of the magnitude and direction of misalignment. Research in visual cognition has shown that people can readily detect when concentric circles are off alignment, in comparison to other sighting methods.

The leveling posts 10*b* mounting the device can have a lower portion with a threaded lower end countersunk into the surface 20 of the club head, and an upper portion journalled in a shoulder bearing aperture of the peripheral ring 10*a* with a threaded lower end that can be threaded into or out of a receiving threaded aperture in the lower portion, so as to lower or raise that portion of the mounting ring 10*a*. In this manner, the alignment of the sighting axis SA can be readily adjusted. A layer 12*c* made of an elastomer or rubber material may be provided as a shock absorbing layer, or it may be formed as a mounting layer supporting the planar disc device and fastened to the club head by adhesive, fastener, suction, etc. The lens element may be made of glass, high density translucent plastic, or other material having an index of refraction. The device can be made as a small, flat part the size of a nickel or quarter, so as to be unobtrusive when mounted on the club head. It can be fitted on any club that has a flat portion of sufficient size on its upper surface.

In FIG. 2C, another version of the planar disc embodiment is shown having a lenticular element 14*a* integrally formed with the mounting ring 10*a* superimposed on an image layer 14*b*. As is well known in the industry, the lenticular element can be formed as an extruded plastic sheet having has a large number of fine lens elements formed as lines or circles across its planar surface. It is superimposed on an image layer having similarly fine, color or image lines (grid) or circles (grill) alternating with non-image or off-image (white) areas. This type of lenticular element is commonly used in children's toys to present one image at one angle of view and shift to another image at another angle of view. In the device, the lenticular element is designed to provide an image of concentric circles when the user's line of sight is aligned with the sighting axis SA, and to provide a non-image (x) when it deviates from the sighting axis SA. The lenticular element 14*a* does not provide an indication of the magnitude and direction of misalignment as does the lens version, however, it can provide an on-target indication across the surface area of the device as long as the user's eye position is at the same angle to the lenticular surface as the sighting axis SA. Thus, it provides a small leeway for the user to locate the position of proper alignment, as indicated by the multiple arrows parallel to the sighting axis SA.

The target indication may be provided by other forms and shapes besides circles, for example, triangle, square, hexagon, star, or other geometrical shapes. The inner shape is proportioned to be smaller than the outer shape for easy eye recognition as to their relative position to each other. The inner shape can be filled in with a high visibility color.

Figure 3:
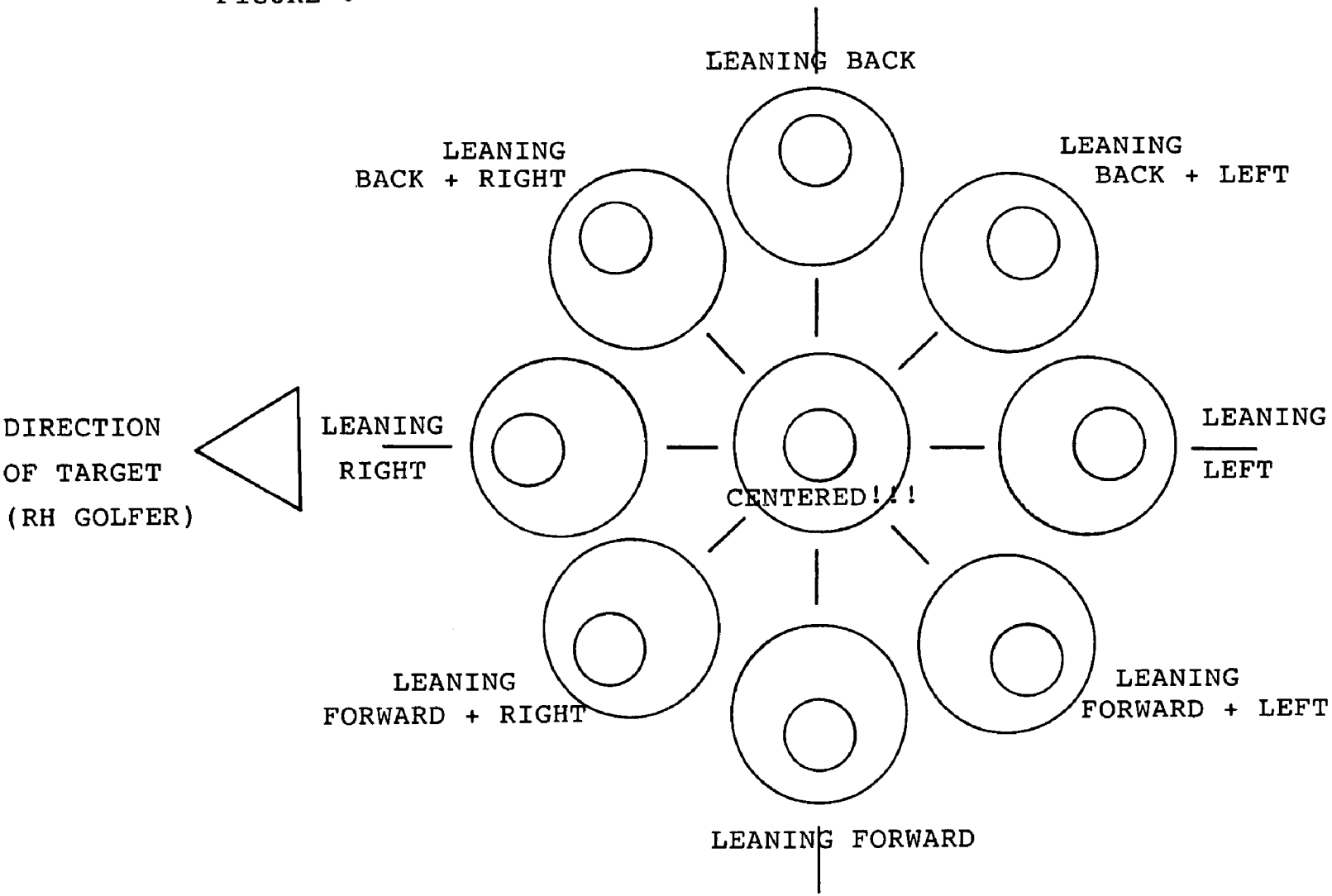
FIG. 3 illustrates use of the device for accurate alignment sighting, as well as providing an indication of the direction of misalignment.

FIG. 3 illustrates what the user of the first version of the disc embodiment of the device may see. For a right-handed (RH) golfer setting up to hit the golf ball toward a target to the left-hand side of the figure, the inner and outer circles appear concentric when the user's head (eyes) is aligned with the sighting axis SA of the device. If the user deviates from the sighting axis, the inner circle will appear to be displaced to one side of the outer circle, indicating that the user is leaning back or forward and/or left or right, relative to the position and/or angle of inclination of the club head.

In FIGS. 4A–4C, a second embodiment of the device is shown, designed for a putter. The device is formed in a spherical shape 40 mounted between upper and lower horizontal flanges of the putter head, and clamped in position with an annular collar 43 retained by threaded screw fasteners 41. The spherical device 40 can be made of a medium-hard plastic or dense rubber material, so as to provide a friction holding force when clamped by the collar 43 against the bottom flange of the putter. An annular opening 42 at its top-facing side leads into a hollow tube aligned with the sighting axis SA extending into the spherical body. The bottom plane or shoulder 42*a* of the tube has a contrasting color or texture imprinted thereon that serves as an inner circle of the target indicator. A color-contrasting edge is imprinted or decal is adhered around the annular opening 42 to serve as an outer circle of the target indicator. The desired target indicator of concentric circles is provided when the user's line of sight is aligned with the sighting axis SA of the tube. The device also provides an indication of the direction of misalignment, by the parallax displacement or eclipsing of the inner circle relative to the outer circle. The sighting axis SA of the device can be adjusted by loosening the fastening screws 41 holding the collar 43, realigning the spherical body, and re-tightening the collar. A swing targeting line 44 may also be provided, as is common in conventional putters.

Besides a spherical shape, the 3D device body in the above-described embodiment can also be made in a semi-spherical, cone, cylindrical shape, or other shapes. It is important only that a larger outer circle or target shape is provided and a smaller inner circle of target shape is provided at a given depth, such as 5–10 mm, within the device body so as to allow the user to discern by parallax when the line of sight is aligned with the sighting axis, and when it is not. The device body should provide 3D rotational freedom so that it can be adjusted to any desired sighting angle. The outer and inner target shapes should be in fixed, depthwise positions relative to each other. The device body can be solid or hollow, or transparent or opaque to undirected light. It can be made of any suitable type of material, such as glass, plastic, amorphous fiber, composites, etc., that can withstand the forces generated by the impact of the club with the golf ball.

Figure 5A:
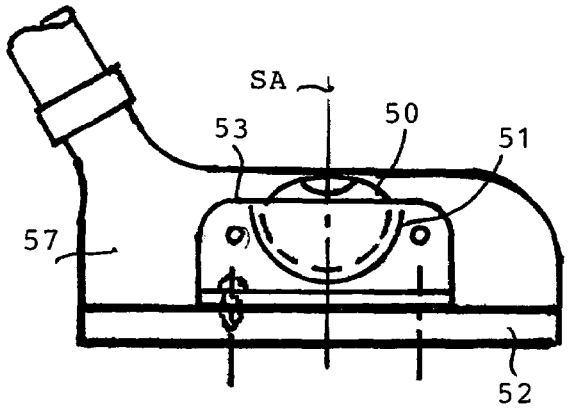
FIG. 5A illustrates a third embodiment of the device for a putter formed as a spherical body held in a mounting cup.
Figure 5B:
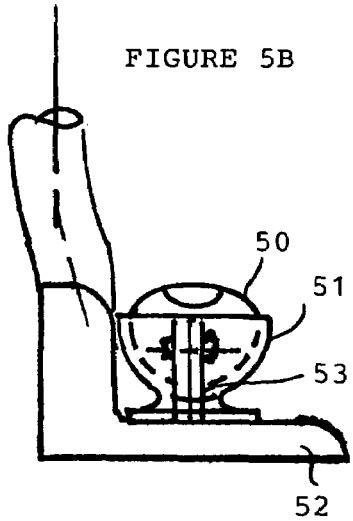
FIG. 5B shows a side elevation view.
Figure 5C:
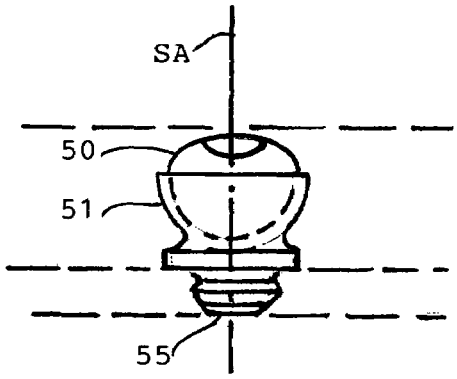
FIG. 5C shows a version using a threaded post mounting.
Figure 5D:
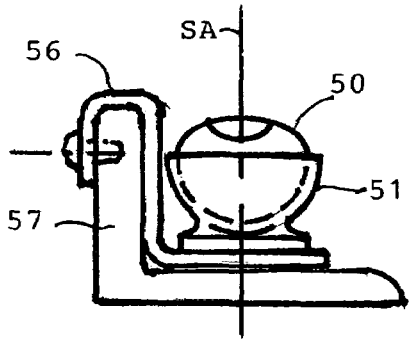
FIG. 5D shows a flange mounting.

In FIGS. 5A–5D, a third embodiment of the alignment sighting device has a spherical body 50 (as in the second embodiment) mounted with an interference fit in a mounting cup 51, and the cup 51 is mounted on a fixed part of the putter. In FIGS. 5A and 5B, a flange 53 is integrally formed with the cup and fastened with bolts or threaded screws into a flat bottom surface 52 of the putter. In FIG. 5C, another version of the cup 51 has a threaded lower end 55 that is screwed into a countersunk holes in the putter's bottom surface. In FIG. 5D, yet another version has the cup mounted to an L-shaped bracket 56 that is clamped or bolted to an upright surface 57 of the putter. The interference fit in the cup, for adjustment and holding the spherical body in a desired position of the sighting axis SA, is provided by turning an expansion plug in the spherical body 50, as described in further detail below.

Figure 6:
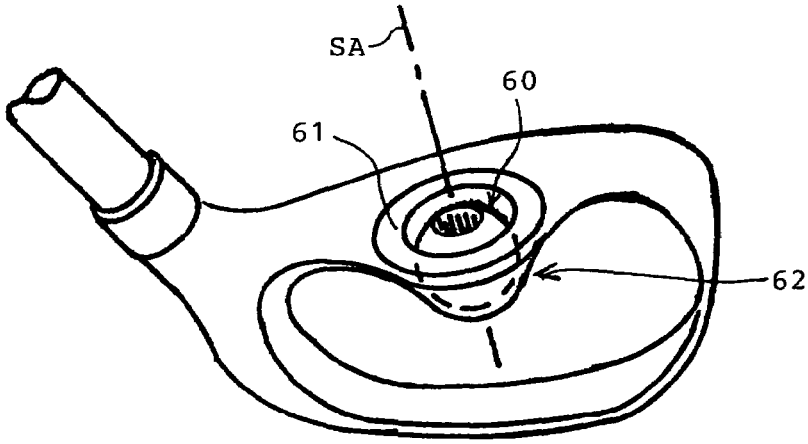
FIG. 6 illustrates a fourth embodiment of the device for an iron club formed as a spherical body held in a mounting socket.

In FIG. 6, a fourth embodiment of the device is shown adapted for an iron club. A spherical body 60 is used for the alignment sighting device, as in the third embodiment, mounted in a mounting socket 62 formed in an upper surface of the club head. A contrasting color ring 61 can be adhered by a decal to provide the outer circle of the target indicator. As in the third embodiment, the spherical device is retained tightly in any desired angular position in the mounting socket by turning the expansion plug.

Figure 7A:
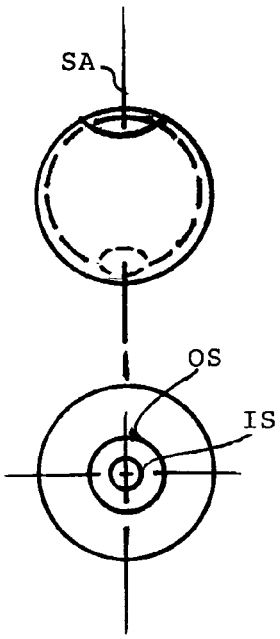
FIGS. 7A, 7B, and 7C illustrate different versions of the 3D device body.
Figure 7B:
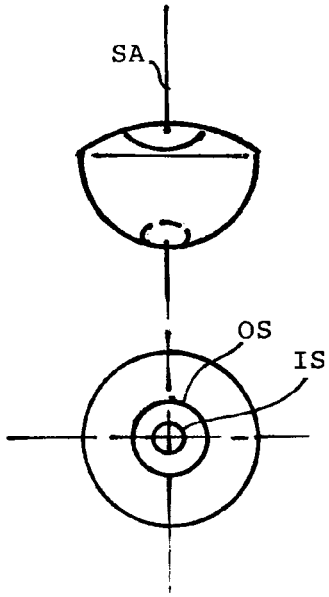
Figure 7C:
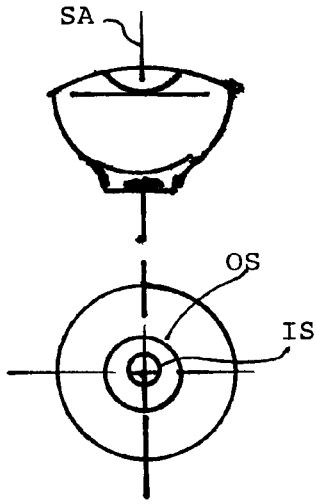
Figure 7D:
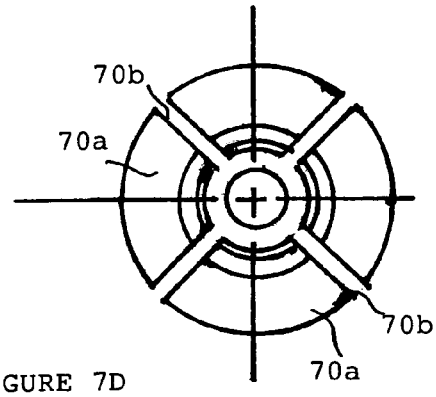
FIGS. 7D, 7E, and 7F show the expansion plug used to fasten the device body in its mounting cup or socket.
Figure 7E:
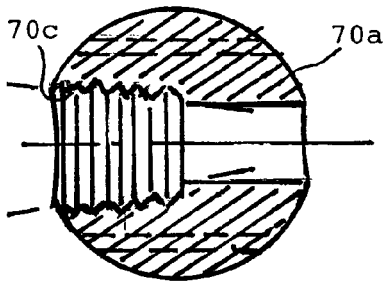
Figure 7F:
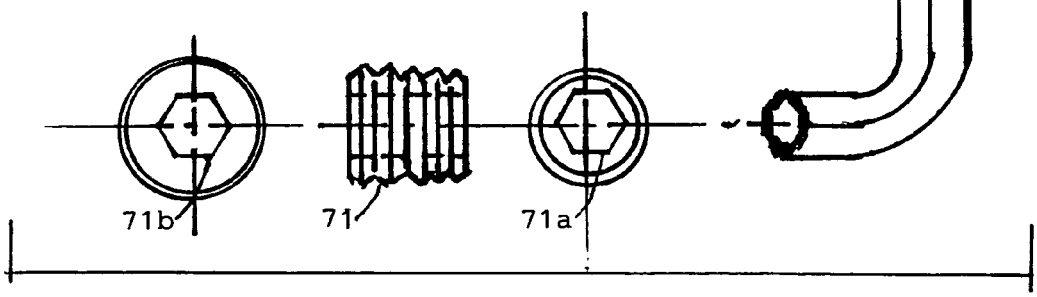

FIGS. 7A, 7B, and 7C illustrate different versions of the 3D device body, including spherical, semi-spherical, and semi-spherical with a truncated cone base. In all cases, the inner targeting shape IS appears concentric with the outer targeting shape OS when sighted along the sighting axis SA. FIGS. 7D, 7E, and 7F show the expansion plug 71 used to fasten the 3D device body in its mounting cup or socket. The device body has axially split sides 70*a*, separated by a small gap 70*b*, that can be expanded outward when the expansion plug 71 is threaded forward into the bottom of the device body. The expansion plug 71 and receiving hole 70*c* have inclined threaded walls such that as the expansion plug is threaded forward into the device body, the expansion plug forces the split walls of the 3D device body slightly apart. The displacement of the walls provides an interference fit to hold the device body firmly in its mounting cup or socket. The expansion plug 71 can be formed with a hex recess 71*a* at its forward end to allow threading using a hex wrench through the annular opening into the device body, and/or with a hex recess 71*b* at its rearward end to allow threading from the rear of the device body.

Figure 8A:
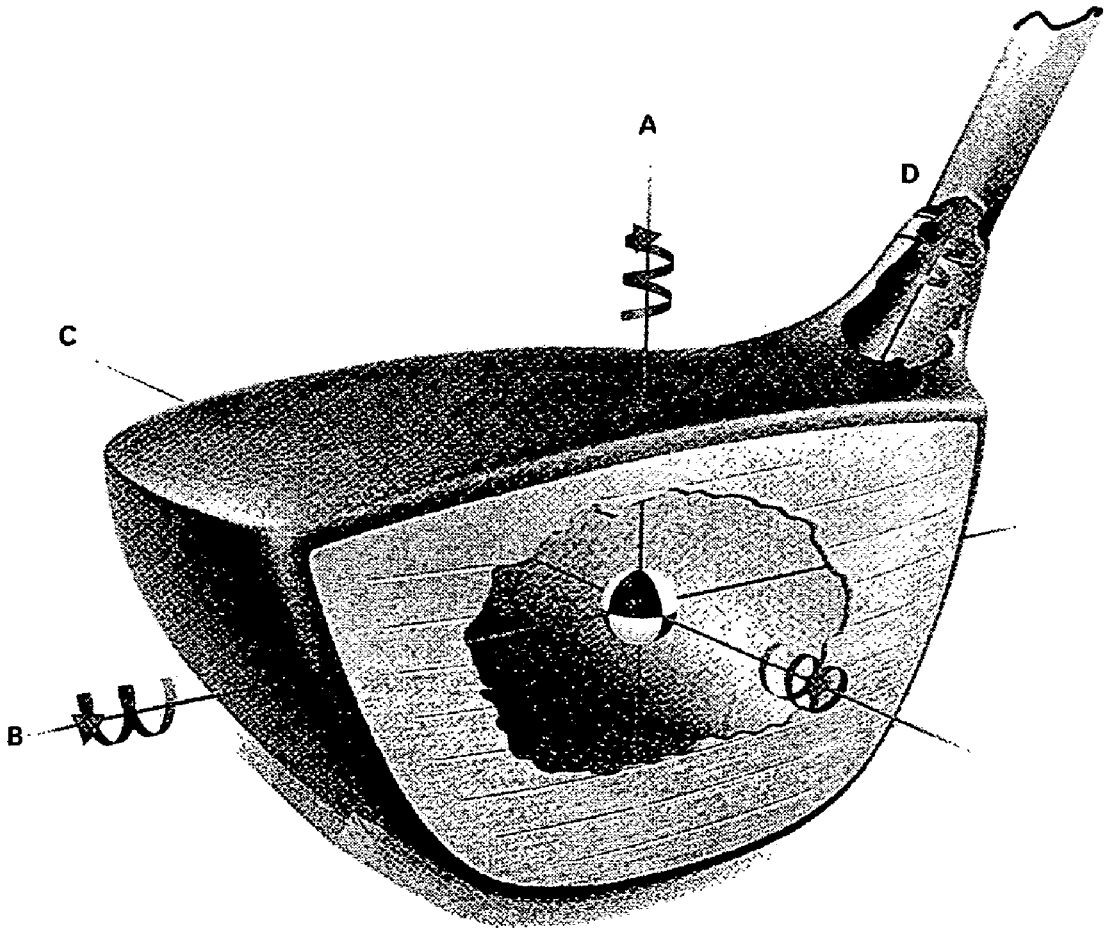
FIG. 8A is a drawing explaining how weight distribution in a driver or wood affects the moment of inertia of the club.

In a fifth embodiment, the alignment sighting device is designed for use in a driver or wood and is combined with a weighting element that allows for adjustment of the club's moment of inertia. In FIG. 8A, an explanation is provided how weight distribution in a driver or wood affects the moment of inertia of the club. In laymen's terms, the moment of inertia (MOI) is a measure of resistance to twisting. MOI is increased by shifting weight distribution as far as possible away from the axis of rotation. The typical driver has a vertical head axis of rotation A, a lengthwise head axis of rotation B, and a sidewards head axis of rotation C, as well as a shaft axis of rotation D. A large head design with high MOI can increase the resistance to twisting around the shaft axis D, which can make it harder to square the club face. To reduce the shaft MOI, it may be desirable to shift some weight to move the center of gravity (checkered ball in the figure) closer to the shaft. In other situations, it may be desirable to shift the center of gravity away from the shaft.

Referring to FIGS. 8B and 8C, the 3D alignment sighting device with split sides (as described above) is adapted to include a weighting element which can be adjusted in a range of positions toward or away from the shaft, or in different quadrants relative to the head axes. The device is shaped as a spherical body 80, as disclosed previously, but has 4 alignment sighting holes 81*a*, 81*b*, 81*c*, 81*d* spaced at 90° quadrants in one plane. The weight 82 is carried in the spherical body spaced from its center and at a selected offset angle such as 45° between two tubes. The spherical body 80 can be is rotated in the plane to bring any of the 4 holes to the top position, thereby rotating the weight 82 to any one of 4 quadrants 82*a*, 82*b*, 82*c*, 82*d* with weight distribution shifted away from the shaft axis. Alternatively, the spherical body can be rotated around the vertical axis to shift the weighting element 82 toward the shaft axis, and rotated in the plane to bring any of the 4 holes to the top position, thereby rotating the weight 82 to any one of 4 quadrants 82*e*, 82*f*, 82*g*, 82*h*. FIG. 8D shows assembly of the spherical body 80 with weighting element 82 clamped by a collar 83 in a socket formed in the club head. The socket is formed to position the device at the center of gravity of the club.

The use of an adjustable weighting element allows weight distribution to be shifted toward or away from the shaft axis, to make it easier for the face of club to stay square or to allow more flexing in the squaring of the club face. Adjusting the weighting element in different quadrants can alter the flight paths of the ball. Adjustment to a high-left quadrant position relative to the center of gravity can make it easier to hit a low draw, whereas adjustment to a high-right quadrant should induce a low fade. Adjustment to a low-left quadrant should make it easier to hit a high draw, whereas adjustment to a low-right quadrant should induce a high fade. Each aiming hole can be marked with the appropriate indices corresponding to its quadrant location within the club and/or ball flight effects.

Figures 9A, 9B, 9C, 9D:
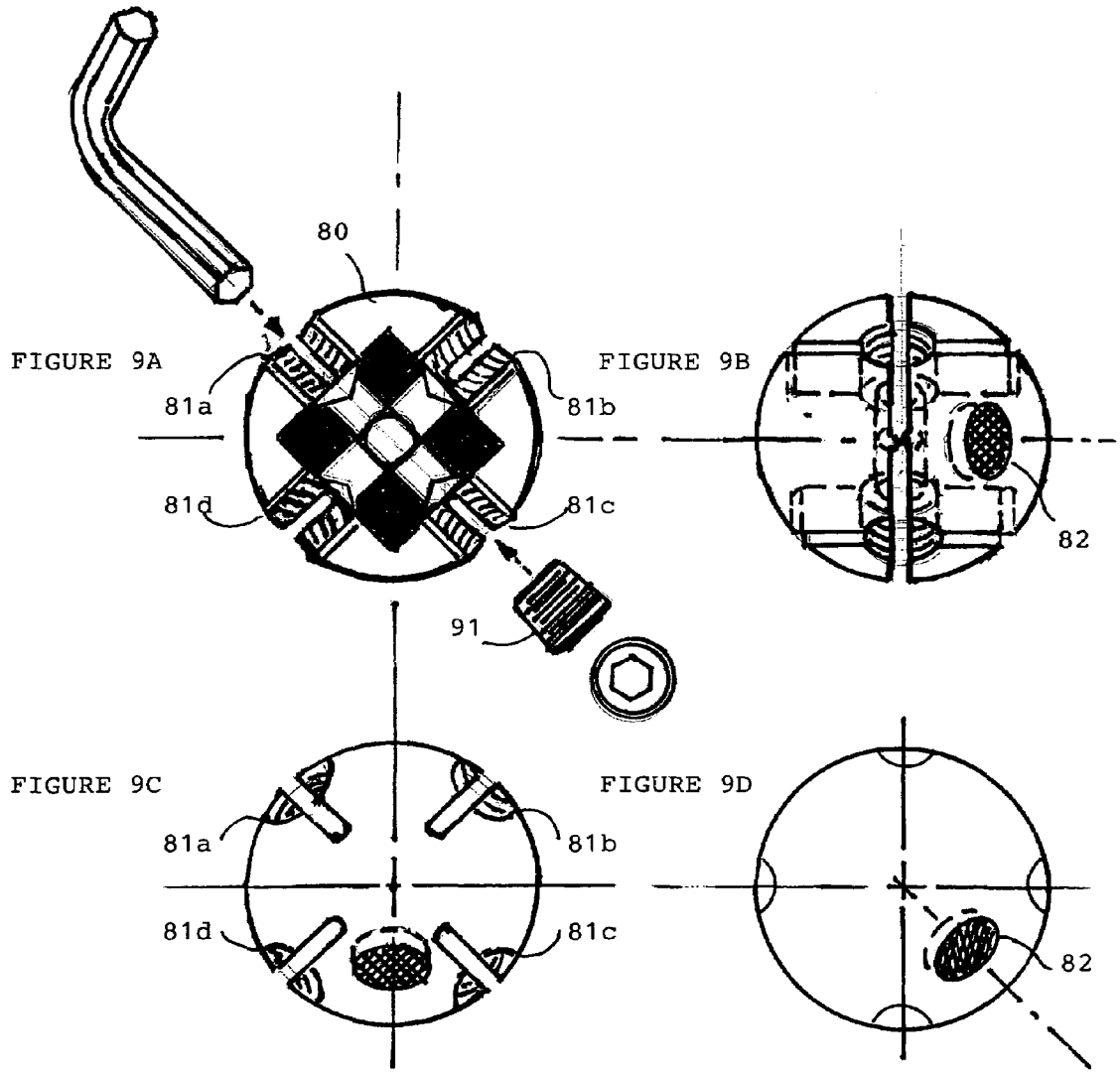
FIGS. 9A–9D show more detailed views of the 3D alignment sighting device with the weighting element.

FIGS. 9A–9D show more detailed views of the 3D alignment sighting device with the weighting element. FIG. 9A is a sectional plan view showing the 4 alignment holes 81*a*, 81*b*, 81*c*, 81*d* having interior threading to allow an expansion plug to be threaded into the hole on the opposite side from the one positioned at the top position. A hex wrench can be inserted through the top hole and used to thread the expansion plug in the bottom hole to fix the body in position in the club head. FIG. 9B is a view along the plane of the holes showing the position of the weight 82. FIG. 9C is an external view showing the 4 alignment holes and the weight 82. FIG. 9D shows the position of the weighting element 82 at a 45° angle between two holes and offset from the center of the spherical body.

While certain embodiments of the invention have been described, it is to be understood that many modifications and variations may be devised given the above-described principles of the invention. It is intended that all such modifications and variations be considered as within the spirit and scope of this invention, as defined in the following claims.

The invention claimed is:

1. An alignment sighting device for a golf club having a shaft attached to a club head comprising:

mounting means for mounting the device to an upper surface of the head of the golf club for facing toward the eyes of the user of the club;

sighting means carried on the mounting means in an adjustable sighting position for providing the user a visual target indicator of desired alignment of the club head with the user's line of sight to the sighting means; and adjusting means carried on the mounting means for adjusting the sighting position of the sighting means to provide a visual indicator of desired alignment according to the user's individual alignment factors and preferences, wherein the device is shaped as a planar disc to be mounted on the upper surface of the head of the golf club, and wherein the device is mounted adjustably on the upper surface of the club head by a number of leveling posts spaced peripherally around its planar disc shape.

2. An alignment sighting device according to claim 1, wherein the device also provides a visual indicator of the magnitude and direction of misalignment when not aligned with the user's line of sight.

3. An alignment sighting device according to claim 1, wherein the device has a concave lens superimposed on a target image to provide the target indicator to the user along its sighting axis.

4. An alignment sighting device according to claim 3, wherein the outer rim of the lens is marked as an outer circle of the target indicator, and the target image seen through the lens serves an the inner circle of the target indicator.

5. An alignment sighting device according to claim 1, wherein the device has a lenticulated grid or grill superimposed on a target image to provide the target indicator to the user along its sighting axis.

6. A golf putter provided with an alignment sighting device on its head comprising:

mounting means for mounting the device to an upper surface of the putter head for facing toward the eyes of the user of the club;

sighting means carried on the mounting means in an adjustable sighting position for providing the user a visual target indicator of desired alignment of the putter head with the user's line of sight to the sighting means; and adjusting means carried on the mounting means for adjusting the sighting position of the sighting means to provide a visual indicator of desired alignment according to the user's individual alignment factors and preferences, wherein the device is shaped as a three-dimensional (3D) body having an opening leading into the device body which provides the target indicator to the user along its sighting axis, wherein the 3D device body is seated between upper and lower horizontal flanges provided on the putter head having its opening exposed through an aperture in the upper flange, and wherein the 3D device body is clamped with an annular collar seated over the aperture in the upper flange.

7. A golf putter provided with an alignment sighting device on its head comprising:

mounting means for mounting the device to an upper surface of the putter head for facing toward the eyes of the user of the club;

sighting means carried on the mounting means in an adjustable sighting position for providing the user a visual target indicator of desired alignment of the putter head with the user's line of sight to the sighting means; and adjusting means carried on the mounting means for adjusting the sighting position of the sighting means to provide a visual indicator of desired alignment according to the user's individual alignment factors and preferences, wherein the device is shaped as a three-dimensional (3D) body having an opening leading into the device body which provides the target indicator to the user along its sighting axis, wherein the device is seated in a mounting cup that is fastened to lower horizontal flange provided on the putter head.

8. A golf putter provided with an alignment sighting device according to claim 7, wherein the mounting cup is fastened to the lower horizontal flange by one of the following group of fasteners: a cup mounting flange; a threaded end of the cup threaded into a countersunk hole in the lower horizontal flange; a bracket.

9. A golf club having a club head provided with an alignment sighting device thereon comprising:

mounting means for mounting the device to an upper surface of the head of the golf club for facing toward the eyes of the user of the club;

sighting means carried on the mounting means in an adjustable sighting position for providing the user a visual target indicator of desired alignment of the club head with the user's line of sight to the sighting means; and adjusting means carried on the mounting means for adjusting the sighting position of the sighting means to provide the visual indicator of desired alignment according to the user's individual alignment factors and preferences, wherein the device is shaped as a three-dimensional (3D) body having an opening leading into the device body which provides the target indicator to the user along its sighting axis, and wherein the 3D device body is mounted in a mounting cup fastened to the upper surface of the club head, and is adjusted and fixed in sighting axis position by having split sides forced apart by a threaded expansion plug for an interference fit in the mounting cup.

10. A golf club having a club head provided with an alignment sighting device comprising:

mounting means for mounting the device to an upper surface of the head of the golf club for facing toward the eyes of the user of the club;

sighting means carried on the mounting means in an adjustable sighting position for providing the user a visual target indicator of desired alignment of the club head with the user's line of sight to the sighting means; and adjusting means carried on the mounting means for adjusting the sighting position of the sighting means to provide the visual indicator of desired alignment according to the user's individual alignment factors and preferences, wherein the device is shaped as a three-dimensional (3D) body having an opening leading into the device body which provides the target indicator to the user along its sighting axis, and wherein the 3D device body is mounted in a socket formed in the upper surface of the club head, and is adjusted and fixed in sighting axis position by having split sides forced apart by a threaded expansion plug for an interference fit in the mounting socket.

11. A golf club having a club head provided with an alignment sighting device thereon comprising:

mounting means for mounting the device to an upper surface of the head of the golf club for facing toward the eyes of the user of the club;

sighting means carried on the mounting means in an adjustable sighting position for providing the user a visual target indicator of desired alignment of the club head with the user's line of sight to the sighting means; and adjusting means carried on the mounting means for adjusting the sighting position of the sighting means to provide the visual indicator of desired alignment according to the user's individual alignment factors and preferences, wherein the device is shared as a three-dimensional (3D) body having an opening leading into the device body which provides the target indicator to the user alone its sighting axis, and wherein the 3D device body is adapted to be mounted through an upper opening of a mounting socket formed in the club head and to be positioned near a center of gravity thereof, wherein said 3D device body has a plurality of alignment sighting holes spaced around the sphere and a weighting element fixed in the spherical body at a predetermined offset position such that it can be positioned in different weight distribution positions in the club head relative to the center gravity depending on which alignment sighting holes is are rotated to provide the sighting means exposed through the upper opening of the mounting socket.

12. A golf club having a club head provided with an alignment sighting device according to claim 11, wherein the 3D device body has 4 alignment sighting holes formed at 90° intervals around a vertical plane with respect to a vertical axis of the club, and the weighting element is positioned between two alignment sighting holes at a position offset from the center of gravity of the club such that it can be positioned in different quadrant positions in the club head relative to the center gravity.

13. A golf club having a club head provided with an alignment sighting device according to claim 11, wherein the weight distribution positions of the weighting element include those shifting the weight distribution toward and away from the shaft of the club.

14. A golf club having a club head provided with an alignment sighting device according to claim 11, wherein the target indicator is provided by one of the following types of sighting means: inner and outer circles; inner and outer triangles; inner and outer squares; inner and outer polygons; inner and outer stars; inner and outer geometrical shapes.

15. A golf club having a club head provided with an alignment sighting device thereon comprising:

mounting means for mounting the device to an upper surface of the head of the golf club for facing toward the eyes of the user of the club;

sighting means carried on the mounting means in an adjustable sighting position for providing the user a visual target indicator indicating a desired alignment of the club head with the user's line of sight to the sighting means; and adjusting means carried on the mounting means for adjusting the sighting position of the sighting means to provide the visual indicator of a desired club head alignment according to the user's individual alignment factors and preferences, wherein the device is shaped as a three-dimensional (3D) body having an opening leading into the device body which provides the target indicator indicating a desired club head alignment to the user along its sighting axis, and wherein the adjusting means is a clamp device that is released to allow the user to adjust the sigbting position of the sigbting means corresponding to a desired club head alignment and then is clamped to hold the device fixedly to the club head with the sighting means providing the user a visual target indicator of the desired club head alignment.

* * * * *